United States Patent [19]

Little

[11] Patent Number: 4,553,006

[45] Date of Patent: Nov. 12, 1985

[54] KEY OPERATED SECURITY SWITCH TO PREVENT UNAUTHORIZED USE OF EQUIPMENT

[75] Inventor: Philip V. Little, Keighley, England

[73] Assignee: Lucas Industries, Birmingham, England

[21] Appl. No.: 591,685

[22] Filed: Mar. 21, 1984

[30] Foreign Application Priority Data

Mar. 25, 1983 [GB] United Kingdom ..... 8308296

[51] Int. Cl.[4] ..... H01H 27/08

[52] U.S. Cl. ..... 200/43.05; 200/292; 70/360

[58] Field of Search ..... 200/44, 45, 42 R, 292, 200/153 LB, 43.07; 70/360

[56] References Cited

U.S. PATENT DOCUMENTS

| | | | |
|---|---|---|---|
| 2,011,944 | 8/1935 | Lodispoto | 200/44 |
| 2,910,860 | 11/1959 | Camba | 70/360 X |
| 4,099,395 | 7/1978 | Garza | 70/360 |
| 4,146,761 | 3/1979 | Sung | 200/44 |

FOREIGN PATENT DOCUMENTS

| | | | |
|---|---|---|---|
| 103935 | 5/1938 | Australia | 70/360 |
| 150923 | 5/1937 | Austria | 200/44 |

*Primary Examiner*—Stephen Marcus

*Assistant Examiner*—Ernest G. Cusick

*Attorney, Agent, or Firm*—Trexler, Bushnell & Wolters, Ltd.

[57] ABSTRACT

A key operated security switch has a housing containing a fixed contact. The housing has a slider provided with contact means movable therewith for slidable, non-rotary movement in the housing. A plurality of locking pins are slidably mounted in recesses formed in the housing and are spring-urged partly into the housing and partly into said slider so as to lock the slider relative to the housing. A plurality of plungers engage at one end with the adjacent ends of said locking pins and at the other end are engageable by the stepped edge of a key inserted into the slot of a barrel rotatably mounted in the housing. The stepped edge of the key projects through the slot of the barrel but does not engage the plungers during insertion or withdrawal. Rotation of the barrel by the key after insertion brings the stepped edge of the key into engagement with at least some of the adjacent ends of the plungers in order to depress them and move the associated locking pins so that none of the locking pins will project into the slider, thereby permitting sliding movement of the slider. Turning movement of the barrel also engages the barrel with the slider whereby axial movement of the barrel and the key will effect similar sliding movement of said slider.

3 Claims, 3 Drawing Figures

KEY OPERATED SECURITY SWITCH TO PREVENT UNAUTHORIZED USE OF EQUIPMENT

FIELD OF THE INVENTION

This invention relates to a security switch which can be used to prevent the operation or use by unauthorised persons of various items of equipment or apparatus. Thus, such a security switch may be used for example as a telephone security lock or as a security lock to control the use of electrical or electrically operated equipment such as radio equipment (civilian or military) or computers. In other examples, a security switch in accordance with the invention can be used to secure the doors or drawers of cabinets, the doors of safes, garages, vehicles, houses or factories, the operation of machine tools and, in other automotive applications, to lock gear boxes or hand brakes or to prevent use of batteries or ignition systems, although it is to be understood that this list of possible applications is by no means exhaustive.

BACKGROUND ART

Key-operable security switches are known which incorporate locks of the kind having a barrel which is rotatably mounted in a housing, the barrel and housing being interconnected, when in a relatively locked position, by a plurality of tumblers which extend through apertures formed in the wall of the barrel and which prevent relative rotation between the barrel and the housing until a key is inserted into a slot or aperture formed in the barrel and successively engage said tumblers and move them into positions in which they do not interconnect the barrel and the housing. In such an arrangement, once the barrel is free to rotate it can also be arranged to move axially relative to the housing and the rotary and/or axial movement can be utilised to make or break electrical circuits which can be used to perform the required function or functions of the associated switch. Such a mechanism however suffers from the disadvantage that one edge of the key slides across the aforesaid tumblers as it is engaged with or disengaged from the barrel of the lock, thereby in time tending to cause wear on the tumblers (which means that they normally have to be formed in metal) and/or on the key which may eventually result in malfunctioning of the mechanism. Furthermore the provision of tumblers in a rotatable barrel in a housing leads, to some extent, to a relatively bulky mechanism which may not necessarily fit easily and unobtrusively into apparatus which the security switch is intended to control.

The object of the present invention is to provide a security switch in an improved form which avoids the aforementioned disadvantages.

SUMMARY OF THE INVENTION

In accordance with the invention there is provided a security switch which comprises a housing having fixed contact means, a slider mounted in the housing for slidable non-rotary movement therein and carrying contact means which is movable with the slider relative to said fixed contact means, a plurality of locking pins which are located in the housing and which are each movable in a direction transverse to the direction in which the slider can slide relative to the housing, a plurality of plungers mounted in the slider which are not all of equal length and which are each engageable at one end with the adjacent end of an adjacent locking pin, said locking pins being urged by resilient means towards an operative, locking position in which at least some of them extend partly into the slider to prevent sliding movement thereof, a barrel disposed in said housing so as to be axially and angularly movable therein, said barrel being formed with a key slot which extends through the wall of the barrel so as to be adapted to receive a key having an edge which is of stepped configuration and which, when the key is inserted into the key slot of the barrel will project through the barrel wall, said key slot then being in a position in which said stepped edge of the key does not engage the ends of the plungers remote from the locking pins as the key is inserted into the barrel, whereas upon subsequent turning of the key and the barrel, said stepped edge will engage at least some of said ends of the plungers remote from the locking pins and cause movement of said plungers to push the locking pins into an inoperative unlocked position in which they do not extend into the slider and in which the plungers do not extend outwardly of the slider so as to permit sliding movement thereof, such sliding movement of the slider then being effected by axially moving the key and the barrel.

Conveniently, the number of locking pins provided is one greater than the number of plungers. Furthermore, gating means may be provided if desired to ensure that in use the key cannot be turned in the barrel to a position which permits its withdrawal from the barrel until the barrel has been moved axially back to its original position before the key was inserted.

DESCRIPTION OF DRAWINGS

The invention will now be more particularly described with reference to the accompanying drawings wherein.

DESCRIPTION OF ONE EMBODIMENT OF THE INVENTION

Figure 1:
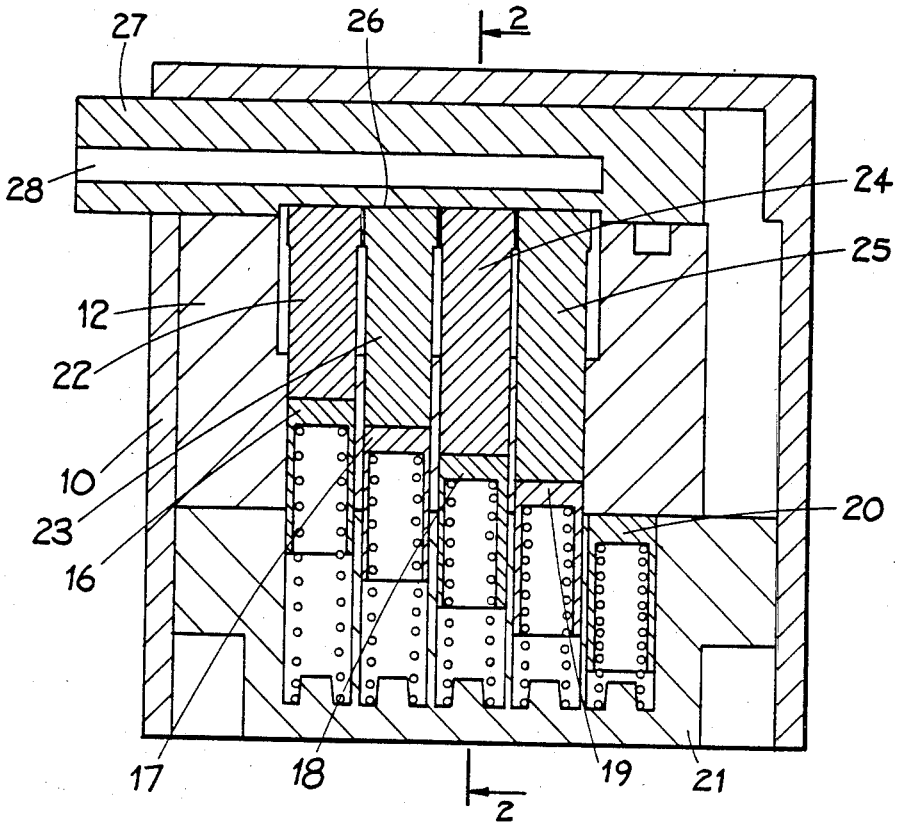
FIG. 1 is a sectional elevation of one example of a security switch constructed in accordance with the invention.

Referring now to the security switch shown in the drawings there is provided a housing 10 having fixed contact means which, in the embodiment described, are conveniently provided by the conductors of a printed circuit board 11 (see FIG. 2) which is inserted into one side of the housing. The switch is also provided with a slider 12 which is located within the housing and in which is mounted contact means 13 and 14 which are movable with the slider and which act to connect various conductors on the printed circuit board depending upon the position of the slider relative to the printed circuit board. The latter is electrically connected externally to a source of supply and/or equipment which it is designed to control by means of a plurality of connectors of which one is indicated in FIG. 2 by reference numeral 15.

The switch is also provided with a plurality of locking pins 16, 17, 18, 19 and 20 which are located in a plurality of recesses formed in the base 21 of the switch, each of said locking pins being urged upwardly (as shown in the drawings) by a spring such as spring 22a in a direction towards the slider 12.

Located within the slider are a plurality of plungers 22, 23, 24, 25 which are individually movable in vertical directions in recesses formed in said slider 12. In the embodiment now described it will be noted that there are four plungers but five locking pins i.e. the number of locking pins is one greater than the number of plungers. It will also be noticed that the plungers 22, 23, 24 and 25 are not all of equal length and in the inoperative or "off" position of the switch seen in FIG. 1 the slider 12 is at the left-hand end of its range of movement and four of the locking pins namely pins 16, 17, 18 and 19, urged upwardly by their respective springs 22a, push the aligned plungers 22, 23, 24 and 25 upwardly until their upper ends engage a flat 26 (see FIG. 2) formed on the exterior of a generally cylindrical barrel 27 which is located in the upper part of the housing 10. Thus in the position shown in FIG. 1 the locking pins 16, 17, 18 and 19 extend partly into the slider and thus prevent sliding movement of the slider to the right.

Figure 2:
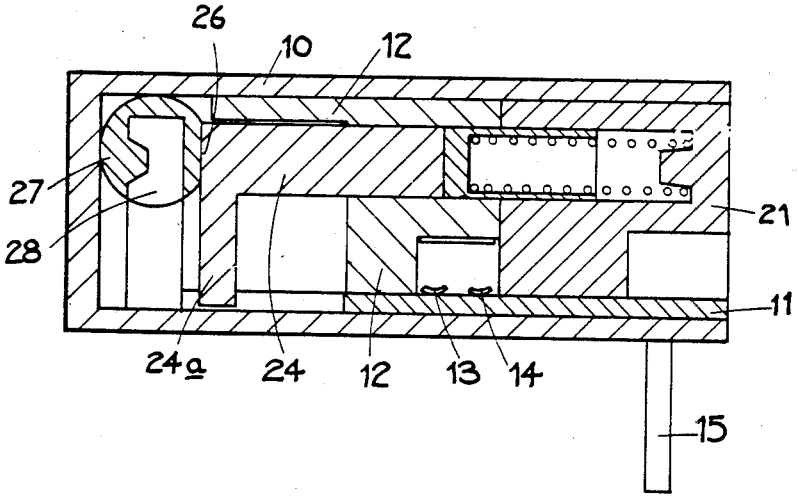
FIG. 2 is a sectional view taken on the line 2–2 of FIG. 1.
Figure 3:
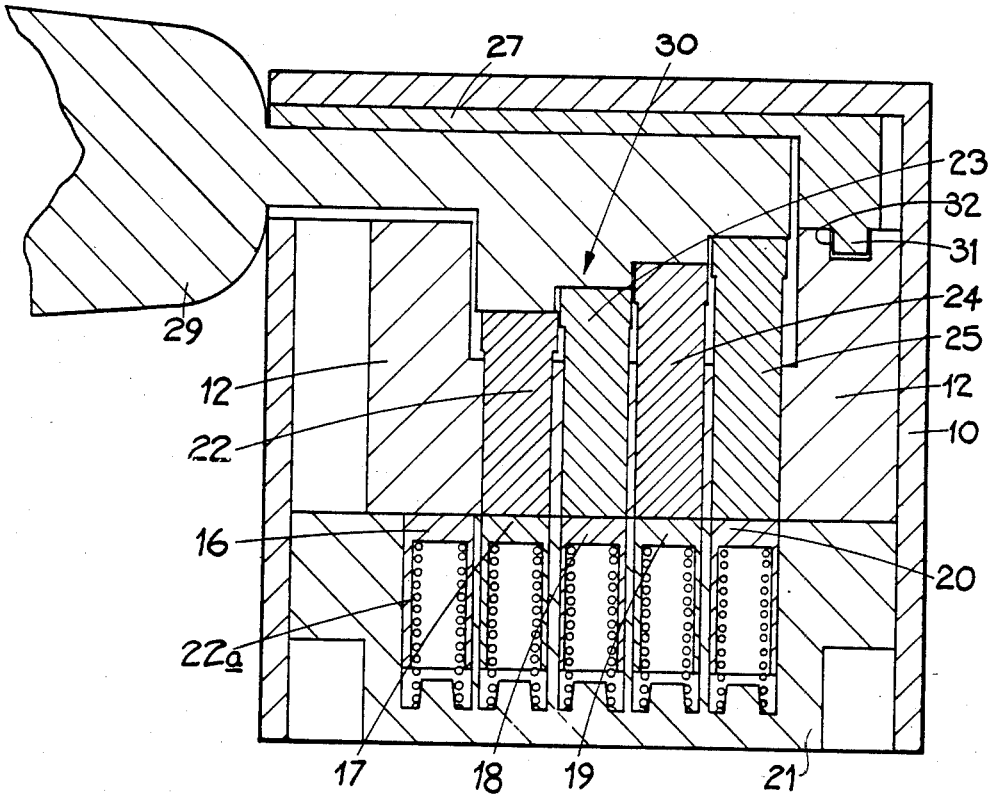
FIG. 3 is a view similar to that shown in FIG. 1 but having a co-acting key inserted into the switch and the slider of the switch moved into an operative position.

The aforementioned barrel 27 has a key slot 28 arranged to receive a key 29 (see FIG. 3), said key slot 28 extending through the wall of the barrel as will be seen in FIG. 2. The key 29 is of flat configuration but one edge, indicated by reference numeral 30 in FIG. 3, is of stepped configuration and when the key is inserted into the barrel said stepped edge projects through the barrel wall. Furthermore each of said plungers, as shown with reference to plunger 24 seen in FIG. 2, has at its upper end a laterally directed extension 24a so that after the key 29 has been inserted into the barrel 27, when the switch is in the position shown in FIGS. 1 and 2, the key can be turned to turn the barrel so that the aforesaid flat 26 moves away from the upper ends of the plungers and the stepped edge 30 of the key will then engage the lateral extensions of the plungers (such as extension 24a of plunger 24) and will therefore depress said plungers which in turn depress the locking pins with which they are engaged. Thus, considering FIG. 1, the plungers 22, 23, 24 and 25 will be depressed to push downwardly the respectively aligned locking pins 16, 17, 18 and 19 so that the upper ends of the latter will then lie in the common plane represented by the bottom of the slider 12 and the top of the base portion 21. It will also be noticed in FIG. 1 that the locking pin 20 is already in its depressed position being held there by the right-hand end of the slider 12. Turning of the barrel 27 by the key 29 will also result in a projection 31 at the end of the barrel engaging a groove 32 formed at the right-hand end of the slider and thus the switch is in a position in which the slider can now be pushed by axially moving the key 29 and the barrel 27 to bring the slider to the right-hand end of its travel as seen in FIG. 3. In this position the left-hand locking pin 16 will now be covered by the left-hand end of the slider whilst the locking pins 17, 18, 19 and 20 are held in their depressed positions by the plungers 22, 23, 24 and 25. Movement of the slider from the inoperative or "off" position shown in FIG. 1 to an operative or "on" position shown in FIG. 3 will of course result in different conductors on the printed circuit board 11 being connected or bridged by the contacts 13 and 14 carried by the slider.

It will be appreciated that the key can be turned back from its position seen in FIG. 3, thus allowing the plungers to resume their respective positions shown in FIG. 1 and in turn allowing the locking pins 17, 18, 19 and 20 to be urged upwardly by their respective springs 22a to lock the switch in its operative or "on" position.

Alternatively, there may also be provided a ring or bezel (not shown) which is connected to the upper part of the left-hand side of the housing 10 as seen in FIG. 1 in order to provide a shroud for the projecting end of the barrel 27 and furthermore gating means may be provided (for example in said ring or bezel) to ensure that the key 29 cannot be turned back from the position seen in FIG. 3 to its initial position which will permit withdrawal of the key until the key and the barrel have first been axially pulled back to carry the slider back to its initial position shown in FIG. 1.

It will be understood therefore that rotary and axial movement of the key are necessary to move the slider from the "off" position shown in FIG. 1 to the "on" position shown in FIG. 3 but that the construction may be such that then either the key can be withdrawn whilst the slider remains locked in its "on" position or alternatively the key cannot be withdrawn until the slider is returned to its "off" position. In either case, the relatively small opening to the interior of the housing afforded by the key slot means that ingress of dust into the housing will be kept to a minimum.

A security switch formed in accordance with the invention is "flat" and relatively compact so that it can be easily and unobtrusively fitted with apparatus (such as telecommunication apparatus) with which it is required to be used. Furthermore, since the steps of the key do not engage the plungers when the key is either being inserted or removed from the barrel, the wear of the key and the adjacent ends of said plungers will be minimised. Such an arrangement provides the advantage (as compared with some known forms of security switches) that the tumblers can be formed in a synthetic resin material (instead of in metal) which not only enables more complex shapes to be used, as compared with metal tumblers, but also leads to a less expensive construction.

I claim:

1. A security switch comprising a housing, a plurality of fixed contacts in said housing, a slider mounted in the housing for slidable non-rotary movement therein, a plurality of contacts on said slider movable with the slider relative to said fixed contacts, a plurality of locking pins transversely mounted in said housing and each movable in a direction transverse to the direction in which the slider can slide relative to the housing, a plurality of plungers mounted in the slider and each having an adjacent and a remote end, said plungers being respectively engageable at the adjacent end with a locking pin, at least some of said plungers being of different lengths, a plurality of resilient members respectively urging said locking pins towards an operative, locking position in which at least some of said locking pins extend partly into the slider to prevent sliding movement thereof, a barrel disposed in said housing so as to be axially and angularly movable therein, said barrel having a key slot extending through a wall of the barrel and adapted to receive a key having an edge which is of stepped configuration and which, when the key is inserted into the key slot of the barrel will project through the barrel wall, said key slot then being in a position in which said stepped edge of the key does not engage the remote ends of the plungers as the key is inserted into the barrel, whereas upon subsequent turning of the key and the barrel, said stepped edge will engage at least some of said remote ends of the plungers and cause movement of said plungers to push the locking pins into an inoperative unlocked position in which they do not extend into the slider and in which the plungers do not extend outwardly of the slider so as to permit sliding movement thereof, such sliding movement of the slider then being effected by axially moving the key and the barrel.

2. A security switch as claimed in claim 1 wherein the number of locking pins is one greater than the number of plungers.

3. A security switch as claimed in claim 1 or claim 2 wherein said fixed contact means comprises conductors of a printed circuit board mounted in the housing.

* * * * *